US012389958B1

(12) United States Patent
Li

(10) Patent No.: US 12,389,958 B1
(45) Date of Patent: Aug. 19, 2025

(54) GARMENT

(71) Applicant: Shenzhen Chuangrui Zhongnuo Technology Co., Ltd., Shenzhen (CN)

(72) Inventor: Jianhua Li, Putian (CN)

( * ) Notice: Subject to any disclaimer, the term of this patent is extended or adjusted under 35 U.S.C. 154(b) by 0 days.

(21) Appl. No.: 18/814,772

(22) Filed: Aug. 26, 2024

(30) Foreign Application Priority Data

Aug. 14, 2024 (CN) ..... 202421964890.3

(51) Int. Cl.
*A41D 13/005* (2006.01)
*A41D 13/002* (2006.01)

(52) U.S. Cl.
CPC ..... *A41D 13/0053* (2013.01); *A41D 13/0025* (2013.01)

(58) Field of Classification Search
CPC ..... A41D 13/0053; A41D 13/0025
See application file for complete search history.

(56) References Cited

U.S. PATENT DOCUMENTS 5,243,706 A * 9/1993 Frim ..... A41D 13/0025 2/81
5,970,519 A * 10/1999 Weber ..... A41D 13/0025 2/81
6,102,936 A * 8/2000 Augustine ..... A61G 7/05769 607/104
6,128,784 A * 10/2000 Frank ..... A41D 13/0053 2/DIG. 1
7,120,938 B2 * 10/2006 Ichigaya ..... A41D 13/0025 2/81
7,716,940 B2 * 5/2010 Farnworth ..... A62B 17/005 62/259.3
8,082,596 B2 * 12/2011 Pohr ..... A41D 13/0025 2/81
8,465,351 B2 * 6/2013 Smith ..... A41D 13/0025 165/61
10,060,708 B2 * 8/2018 Andresen ..... A41D 13/018
10,278,433 B2 * 5/2019 Esenwein ..... A41D 13/0025
11,000,077 B2 * 5/2021 Davidovits ..... F04D 29/705
11,219,251 B2 * 1/2022 Ichigaya ..... A41D 13/0025
11,707,095 B2 * 7/2023 Tokunaga ..... A41D 13/0025 2/69
11,832,660 B2 * 12/2023 Tokunaga ..... A41D 13/002
12,108,814 B2 * 10/2024 Ichigaya ..... A41D 27/28
2001/0000849 A1 * 5/2001 Siman-Tov ..... A61F 7/10 62/259.3
2004/0083526 A1 * 5/2004 Ichigaya ..... A41D 13/0025 2/2.14

(Continued)

*Primary Examiner* — Alissa L Hoey

(57) ABSTRACT

A garment includes an inner layer, an outer layer, and a fan. The inner layer is equipped with a plurality of air outlets. The outer layer is connected to the inner layer, and an air cavity is formed between the outer layer and the inner layer. The air cavity is provided with an air inlet. The air inlet, the air cavity, and the air outlets are in communication with each other. The fan is positioned at the air inlet. The fan is used for driving air to pass through the air inlet, the air cavity, and the air outlets in sequence. Therefore, the fan can drive air to pass through the air inlet, the air cavity, and the air outlets in sequence, and blow the air out from the plurality of air outlets in the inner layer, thereby blowing air and dissipating heat for a user wearing the garment.

17 Claims, 7 Drawing Sheets

(56) References Cited

U.S. PATENT DOCUMENTS

| | | | | |
|---|---|---|---|---|
| 2006/0026743 | A1* | 2/2006 | Farnworth | A41D 31/145 2/455 |
| 2007/0050878 | A1* | 3/2007 | Ichigaya | A41D 13/0025 2/69 |
| 2008/0289077 | A1* | 11/2008 | Enlund | A41D 13/0053 2/81 |
| 2010/0242147 | A1* | 9/2010 | Pohr | A41D 13/0025 2/69 |
| 2015/0313294 | A1* | 11/2015 | Yue | A41D 13/0025 2/69 |
| 2016/0270457 | A1* | 9/2016 | Chen | A41D 13/0025 |
| 2021/0386129 | A1* | 12/2021 | Ichigaya | A41D 13/0025 |
| 2022/0386712 | A1* | 12/2022 | Ichigaya | A41D 1/002 |
| 2023/0148688 | A1* | 5/2023 | Ichigaya | A41D 27/28 2/69 |
| 2023/0157382 | A1* | 5/2023 | Ichigaya | A41D 13/0025 2/69 |
| 2024/0156185 | A1* | 5/2024 | West | A41D 13/0025 |
| 2024/0315363 | A1* | 9/2024 | Tyler | A41D 13/0025 |

* cited by examiner

GARMENT

CROSS-REFERENCE TO RELATED APPLICATIONS

The application claims priority of Chinese patent application CN2024219648903, filed on Aug. 14, 2024, which is incorporated herein by reference in its entireties.

TECHNICAL FIELD

The present invention relates to the field of clothes, particularly to a garment.

BACKGROUND ART

Wearing clothes in summer can make people feel hot, mainly because clothes affect human body's heat dissipation process. There are four main ways for the human body to dissipate heat: radiation heat dissipation, conduction heat dissipation, convection heat dissipation and evaporation heat dissipation. In hot summer, when the external temperature is high, it is difficult for the human body to dissipate heat through heat rays. Instead, the human body absorbs the surrounding heat, making the body prone to heatstroke in summer. In addition, some jobs require working in high temperatures, and it is difficult for the human body to dissipate heat in such environments, which can lead to heatstroke and even fainting in severe cases. Therefore, there is an urgent need on the market to provide a garment that is easy for the human body to dissipate heat, so that the human body can better adapt to high temperature environments and avoid heatstroke.

SUMMARY

In order to overcome shortcomings of the prior art, a garment is provided in the present invention. The garment includes an inner layer, an outer layer, and a fan. The inner layer is equipped with a plurality of air outlets. The outer layer is connected to the inner layer, and an air cavity is formed between the outer layer and the inner layer. The air cavity is provided with an air inlet. The air inlet, the air cavity, and the air outlets are in communication with each other. The fan is positioned at the air inlet. The fan is used for driving air to pass through the air inlet, the air cavity, and the air outlets in sequence.

As an improvement of the present invention, the inner layer is also provided with a first connection area, and the outer layer is also provided with a second connection area disposed towards the first connection area. The second connection area is connected to the first connection area to form a partition portion. The partition portion divides the air cavity into a plurality of intercommunicated air ducts. The air inlet, the air ducts, and the air outlets are in communication with each other. The fan is used for driving the air to pass through the air inlet, the air ducts, and the air outlets in sequence.

As an improvement of the present invention, a plurality of hollow openings are defined in the inner layer. The first connection area includes a plurality of first connection parts. The second connection area includes a plurality of second connection parts towards the first connection parts. The partition portion includes a plurality of partition units. The first connection parts are positioned at edges of the hollow openings, and the plurality of first connection parts are connected to the plurality of second connection parts to form the plurality of partition units. The partition units are positioned between the hollow openings and the air ducts. The plurality of partition units separate the plurality of hollow openings from the air cavity. The plurality of partition units divide the air cavity into the plurality of intercommunicated air ducts.

As an improvement of the present invention, the plurality of first connection parts are spaced apart from each other, the plurality of second connection parts are spaced apart from each other, the plurality of hollow openings are spaced apart from each other, and the plurality of partition units are spaced apart from each other. The plurality of air outlets and the plurality of hollow openings are spaced apart from each other.

As an improvement of the present invention, the plurality of first connection parts are uniformly arranged along a transverse direction of the inner layer and a longitudinal direction of the inner layer, and the plurality of second connection parts are uniformly arranged along a transverse direction of the outer layer and the longitudinal direction of the inner layer. The plurality of air outlets are uniformly arranged along the transverse direction of the inner layer and the longitudinal direction of the inner layer.

As an improvement of the present invention, the first connection area and the second connection area are connected by a hot melt adhesive body to form the partition portion. Alternatively, the first connection area and the second connection area are connected by stitching lines to form the partition portion. Alternatively, the first connection area and the second connection area are connected by gluing to form the partition portion.

As an improvement of the present invention, the inner layer is an airtight inner layer, and the outer layer is an airtight outer layer.

As an improvement of the present invention, the inner layer includes a first portion and a second portion. The second portion is an airtight second portion, and the second portion covers a surface of the first portion.

As an improvement of the present invention, the second portion is a second PU film or a second TPU film.

As an improvement of the present invention, the outer layer includes a third portion and a fourth portion. The fourth portion is an airtight fourth portion, and the fourth portion covers a surface of the third portion.

As an improvement of the present invention, the fourth portion is a fourth PU film or a fourth TPU film.

As an improvement of the present invention, the inner layer includes a first portion and a second portion. The second portion is an airtight second portion, and the second portion covers a surface of the first portion. The outer layer includes a third portion and a fourth portion. The fourth portion is an airtight fourth portion, and the fourth portion covers the third portion. The first portion includes a first inner surface and a first outer surface. The second portion covers the first inner surface. The third portion includes a second inner surface and a second outer surface. The fourth portion covers the second inner surface. The air cavity is formed between the second portion and the fourth portion.

As an improvement of the present invention, the inner layer is also provided with a first connection area, and the outer layer is also provided with a second connection area disposed towards the first connection area. The second connection area is connected to the first connection area to form a partition portion, and the partition portion divides the air cavity into a plurality of intercommunicated air ducts. The air inlet, the air ducts, and the air outlets are in communication with each other. The fan is used for driving the air to pass through the air inlet, the air ducts, and the air outlets in sequence. The first connection area is positioned in the second portion, and the second connection area is positioned in the fourth portion.

As an improvement of the present invention, the inner layer is a nitrile inner layer.

As an improvement of the present invention, the outer layer is a nitrile outer layer.

As an improvement of the present invention, the inner layer and the outer layer are integrally formed.

As an improvement of the present invention, the inner layer is also provided with a first connection area, and the outer layer is also provided with a second connection area disposed towards the first connection area. The second connection area is connected to the first connection area to form a partition portion, and the partition portion divides the air cavity into a plurality of intercommunicated air ducts. The air inlet, the air ducts, and the air outlets are in communication with each other. The fan is used for driving the air to pass through the air inlet, the air ducts, and the air outlets in sequence. The first connection area and the second connection area are connected by a connecting rib to form the partition portion.

As an improvement of the present invention, the connecting rib is a nitrile connecting rib. The inner layer, the outer layer, and the connecting rib are integrally formed.

As an improvement of the present invention, the inner layer is provided with a first main body portion and a first sleeve portion, and the outer layer is provided with a second main body portion and a second sleeve portion. The first main body portion is connected to the first sleeve portion, and the second main body portion is connected to the second sleeve portion. The plurality of air outlets and the plurality of hollow openings are arranged at intervals along the first main body portion and the second main body portion.

As an improvement of the present invention, the inner layer includes a first portion and a second portion. The second portion is an airtight second portion, and the second portion covers a surface of the first portion. The second portion is adhered to the surface of the first portion by hot melt adhesive. The outer layer includes a third portion and a fourth portion. The fourth portion is an airtight fourth portion, and the fourth portion covers the third portion. The fourth portion is adhered to a surface of the third portion through hot melt adhesive. The hollow openings run through the first portion and the second portion. A plurality of through holes are defined in the fourth portion, and the through holes are oriented towards the hollow openings. A thickness of the second portion is greater than or equal to 0.01 mm, a thickness of the fourth portion is greater than or equal to 0.01 mm, a thickness of the outer layer is greater than or equal to 0.05 mm, a thickness of the inner layer is greater than or equal to 0.05 mm, an inner diameter of the air outlet is greater than or equal to 0.01 mm, and an inner diameter of the hollow opening is greater than or equal to 0.01 mm.

As an improvement of the present invention, the fan is detachably connected to the inner layer or the outer layer, so that the fan is positioned at the air inlet.

The present invention has the following beneficial effects. The garment is provided in the present invention. The garment includes the inner layer, the outer layer, and the fan. The inner layer is equipped with the plurality of air outlets. The outer layer is connected to the inner layer, and the air cavity is formed between the outer layer and the inner layer. The air cavity is provided with the air inlet. The air inlet, the air cavity, and the air outlets are in communication with each other. The fan is positioned at the air inlet. The fan is used for driving air to pass through the air inlet, the air cavity, and the air outlets in sequence. Therefore, the fan can drive air to pass through the air inlet, the air cavity, and the air outlets in sequence, and blow the air out from the plurality of air outlets in the inner layer, so as to blow air and dissipate heat for a user wearing the garment, reduce the user's body temperature, enable the user to work in high temperature environments for a long time, and prevent the user from heatstroke.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
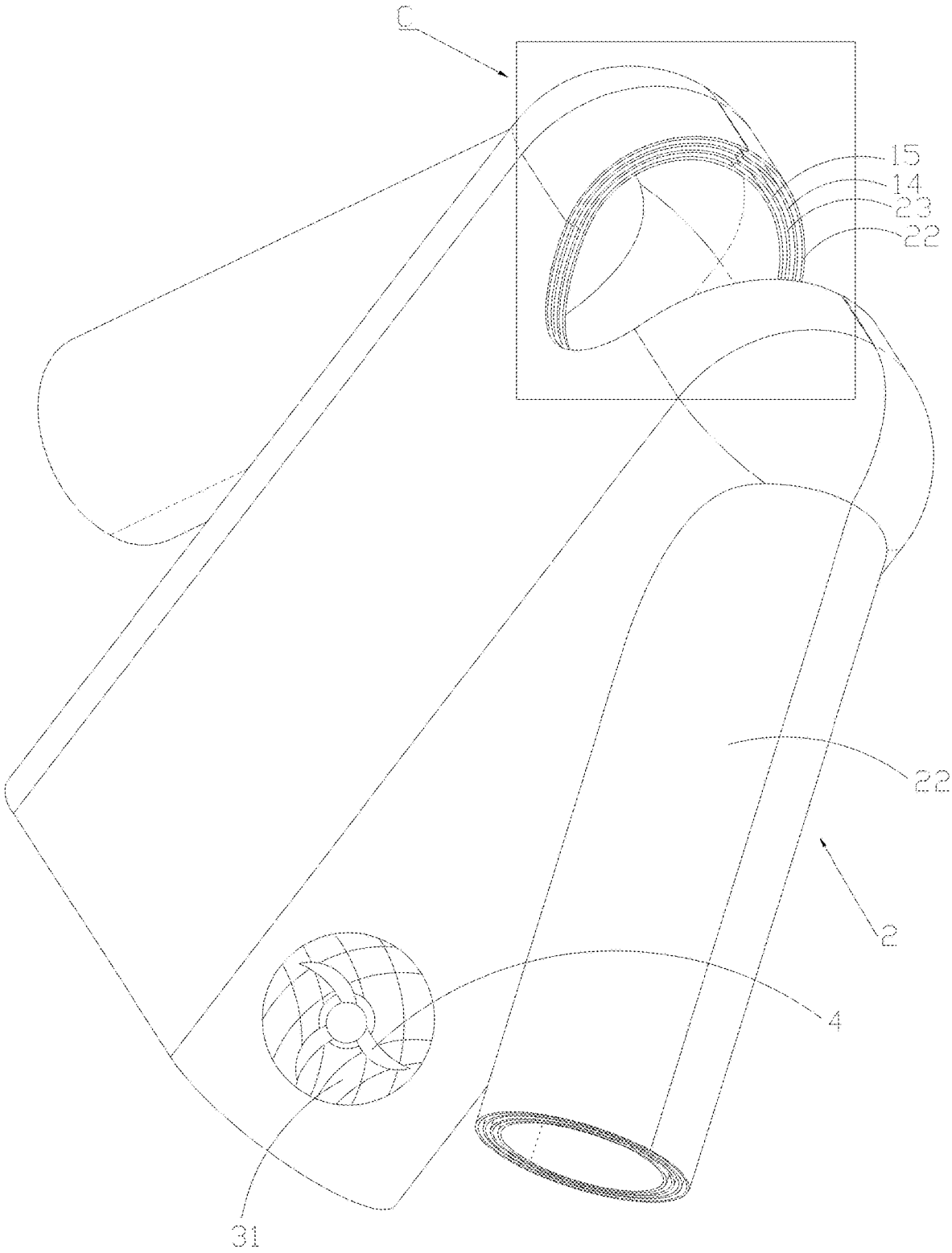
FIG. 1 is a schematic diagram of an overall structure of the present invention.
Figure 2:
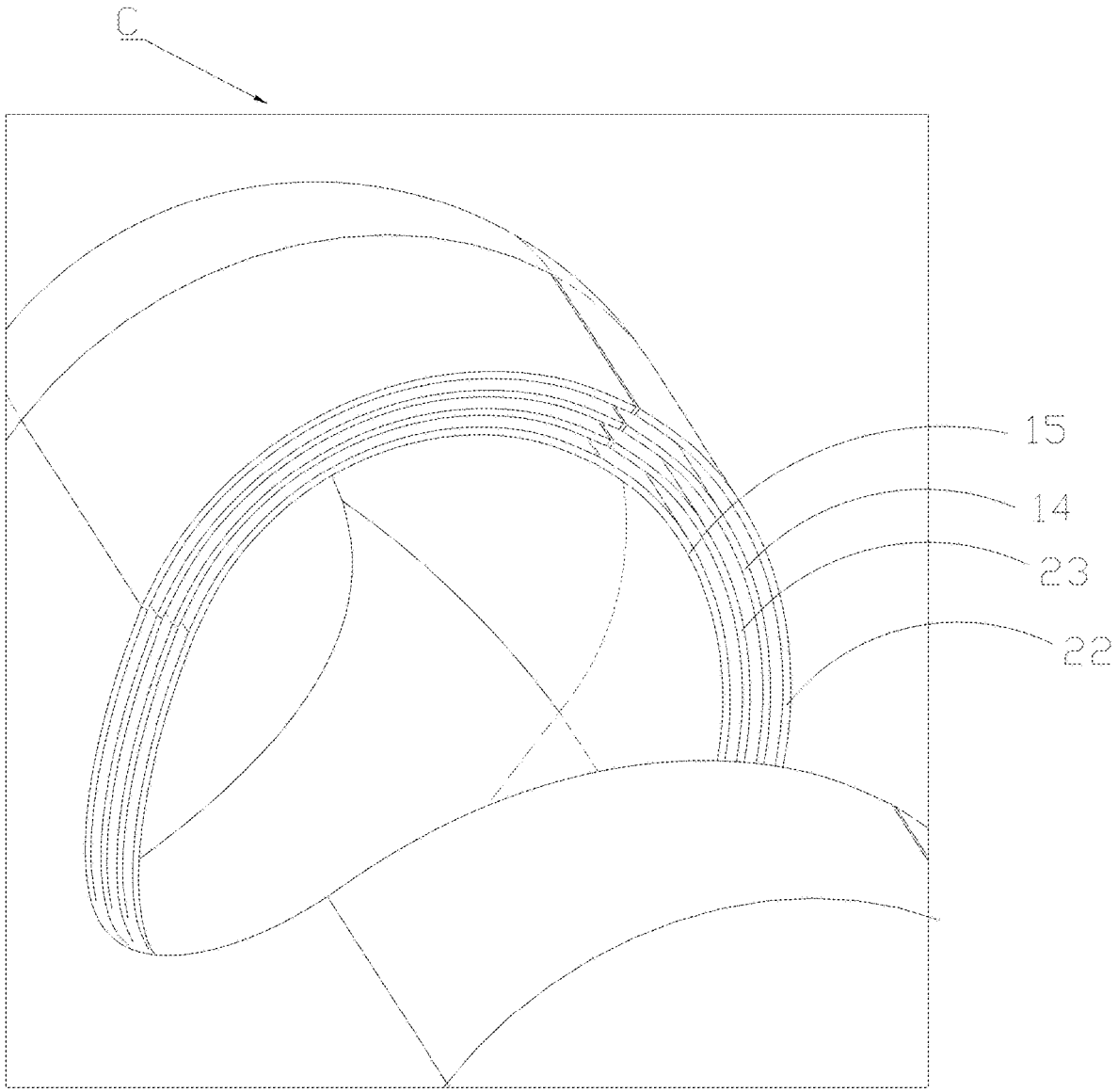
FIG. 2 is an enlarged view of area C in FIG. 1.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Referring to FIGS. 1-7, a garment includes an inner layer 1, an outer layer 2, and a fan 4.

The inner layer 1 is equipped with a plurality of air outlets 11.

The outer layer 2 is connected to the inner layer 1, and an air cavity 3 is formed between the outer layer 2 and the inner layer 1. The air cavity 3 is provided with an air inlet 31. The air inlet 31, the air cavity 3, and the air outlets 11 are in communication with each other.

The fan 4 is positioned at the air inlet 31. The fan 4 is used for driving air to pass through the air inlet 31, the air cavity 3, and the air outlets 11 in sequence.

Through the above structure, the garment includes the inner layer 1, the outer layer 2, and the fan 4. The inner layer 1 is equipped with the plurality of air outlets 11. The outer layer 2 is connected to the inner layer 1, and the air cavity 3 is formed between the outer layer 2 and the inner layer 1. The air cavity 3 is provided with the air inlet 31. The air inlet 31, the air cavity 3, and the air outlets 11 are in communication with each other. The fan 4 is positioned at the air inlet 31. The fan 4 is used for driving air to pass through the air inlet 31, the air cavity 3, and the air outlets 11 in sequence. Therefore, the fan 4 can drive air to pass through the air inlet 31, the air cavity 3, and the air outlets 11 in sequence, and blow the air out from the plurality of air outlets 11 in the inner layer 1, so as to blow air and dissipate heat for a user wearing the garment, reduce the user's body temperature, enable the user to work in high temperature environments for a long time, and prevent the user from heatstroke.

In this embodiment, the fan 4 includes fan blades, a power supply, and a motor. The fan blades are arranged on an output shaft of the motor, and the power supply is electrically connected to the motor for supplying power to the motor.

In this embodiment, the inner layer 1 is also provided with a first connection area 12, and the outer layer 2 is also provided with a second connection area 21 disposed towards the first connection area 12. The second connection area 21 is connected to the first connection area 12 to form a partition portion 5. The partition portion 5 divides the air cavity 3 into a plurality of intercommunicated air ducts 51. The air inlet 31, the air ducts 51, and the air outlets 11 are in communication with each other. The fan 4 is used for driving the air to pass through the air inlet 31, the air ducts 51, and the air outlets 11 in sequence. Through the above structure, the second connection area 21 is connected to the first connection area 12 to form the partition portion 5, and the partition portion 5 divides the air cavity 3 into the plurality of intercommunicated air ducts 51, so that the fan 4 can drive the air to pass through the plurality of intercommunicated air ducts 51 and then blow the air towards the user from the air outlets 11. Moreover, by dividing the air cavity 3 into the plurality of intercommunicated air ducts 51, the air flowing into the air cavity 3 is evenly distributed in the plurality of air ducts 51, making an overall shape of the garment more flat, and preventing excessive expansion of the overall shape of the garment caused by a large amount of air flowing into the air cavity 3, thus preventing the overall shape of the garment from becoming bloated and bulky.

In this embodiment, a plurality of hollow openings 13 are defined in the inner layer 1. The first connection area 12 includes a plurality of first connection parts 121. The second connection area 21 includes a plurality of second connection parts 211 towards the first connection parts 121. The partition portion 5 includes a plurality of partition units 52. The first connection parts 121 are positioned at edges of the hollow openings 13, and the plurality of first connection parts 121 are connected to the plurality of second connection parts 211 to form the plurality of partition units 52. The partition units 52 are positioned between the hollow openings 13 and the air ducts 51. The plurality of partition units 52 separate the plurality of hollow openings 13 from the air cavity 3. The plurality of partition units 52 divide the air cavity 3 into the plurality of intercommunicated air ducts 51. The plurality of first connection parts 121 are spaced apart from each other, the plurality of second connection parts 211 are spaced apart from each other, the plurality of hollow openings 13 are spaced apart from each other, and the plurality of partition units 52 are spaced apart from each other. The plurality of air outlets 11 and the plurality of hollow openings 13 are spaced apart from each other. Specifically, the plurality of first connection parts 121 are uniformly arranged along a transverse direction of the inner layer 1 and a longitudinal direction of the inner layer 1, and the plurality of second connection parts 211 are uniformly arranged along a transverse direction of the outer layer 2 and the longitudinal direction of the inner layer 1. The plurality of air outlets 11 are uniformly arranged along the transverse direction of the inner layer 1 and the longitudinal direction of the inner layer 1. Through the above structure, the partition portion 5 separates the plurality of hollow openings 13 from the air cavity 3, so that no air will flow out from the hollow openings 13. The design of the hollow openings 13 can reduce a total number of layers at the hollow openings 13, so that only fabric of the outer layer 2 is present at the hollow openings 13, allowing natural heat dissipation through the single-layer fabric of the outer layer 2. The hollow openings are hexagonal hollow holes or circular hollow openings.

Figure 3:
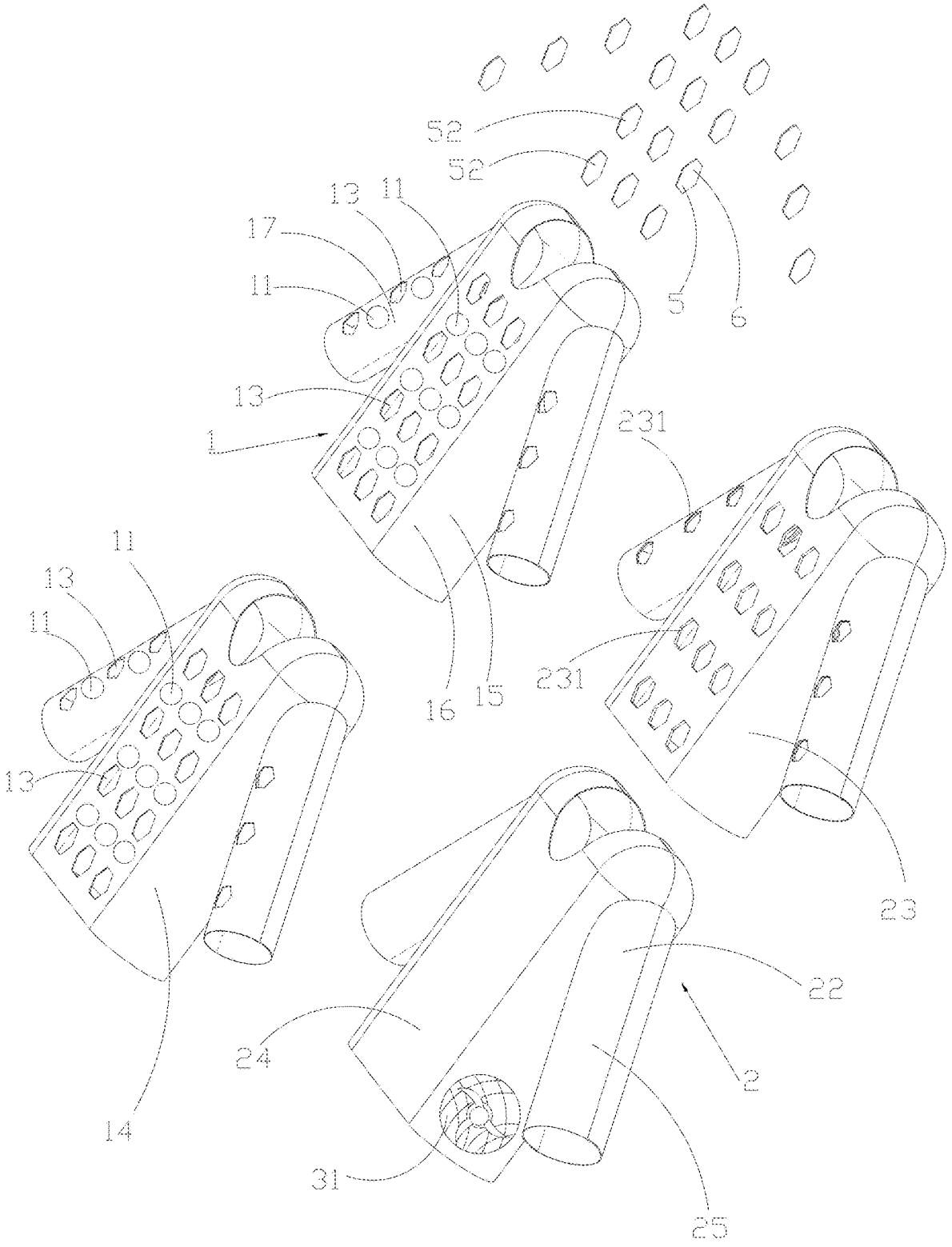
FIG. 3 is an exploded view of the present invention.
Figure 4:
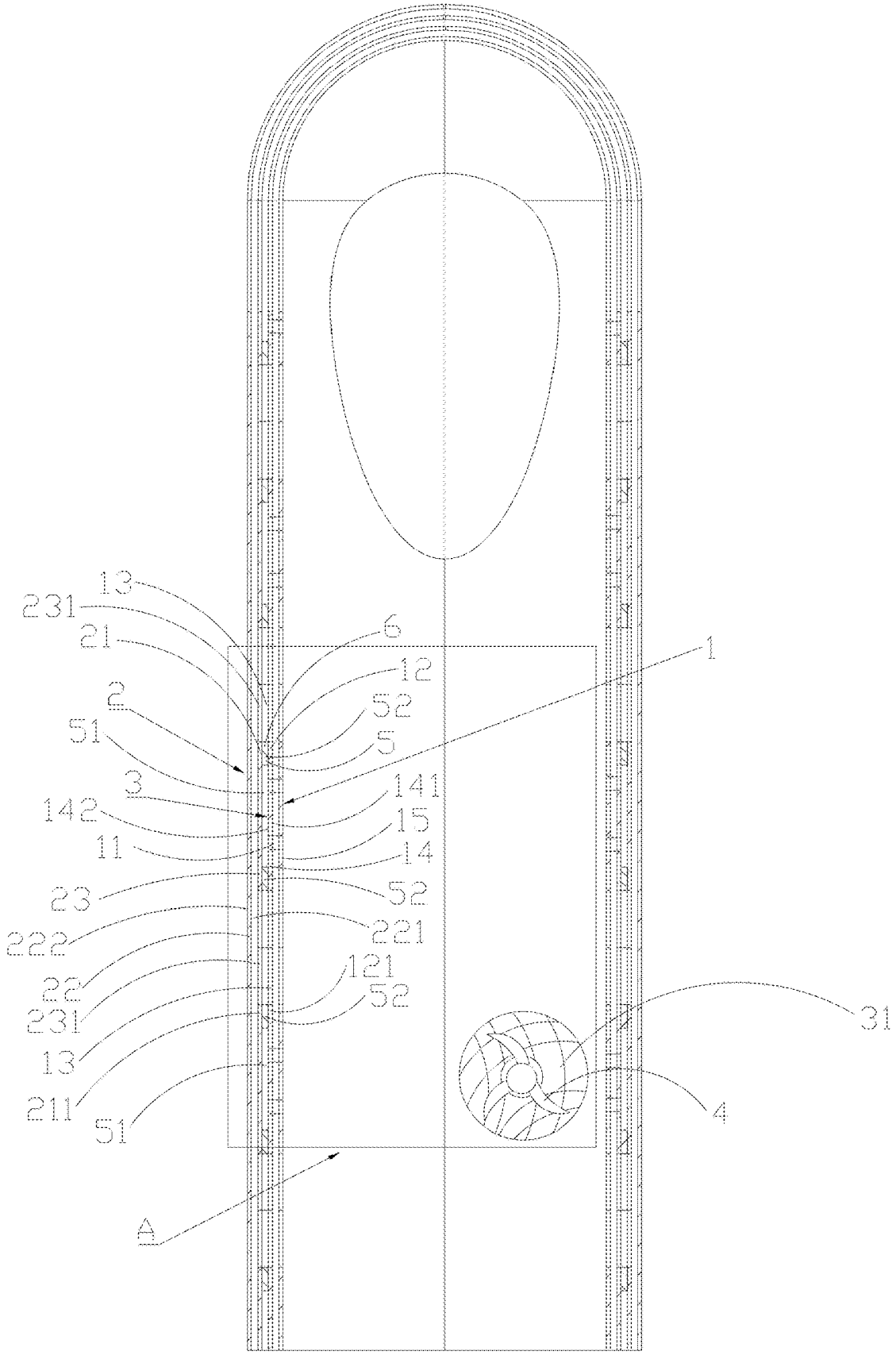
FIG. 4 is a sectional view cut along an inner layer and an outer layer.
Figure 5:
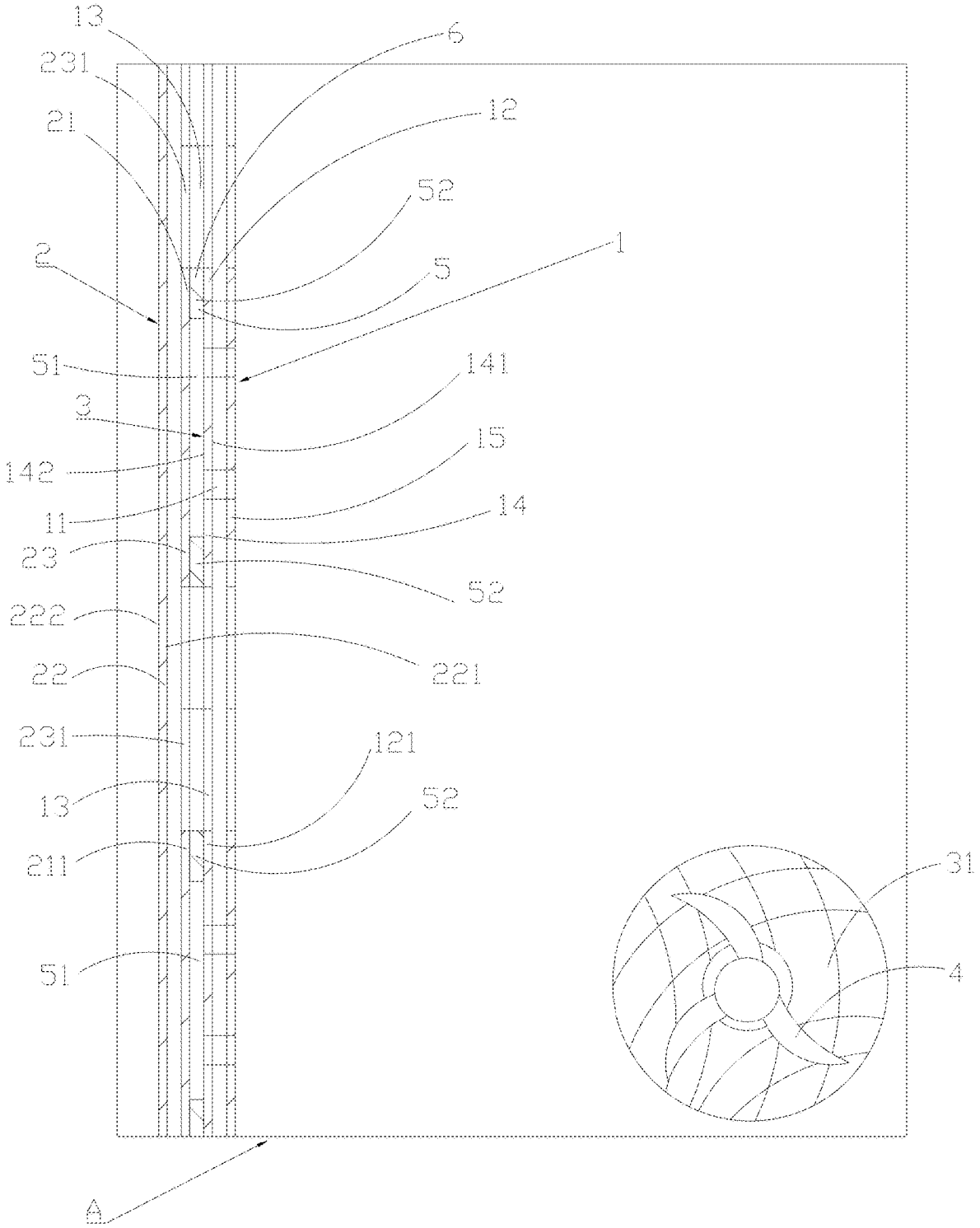
FIG. 5 is an enlarged view of area A in FIG. 4.

Referring to FIGS. 3-5, the first connection area 12 and the second connection area 21 are connected by a hot melt adhesive body 6 to form the partition portion 5. Alternatively, the first connection area 12 and the second connection area 21 are connected by stitching lines to form the partition portion 5. Alternatively, the first connection area 12 and the second connection area 21 are connected by gluing to form the partition portion 5. Through the above structure, the connection between the first connection area 12 and the second connection area 21 is effectively achieved, and an connection area is flat and lightweight.

In this embodiment, the inner layer 1 is an airtight inner layer 1, and the outer layer 2 is an airtight outer layer 2. The inner layer 1 includes a first portion 14 and a second portion 15. The second portion 15 is an airtight second portion 15, and the second portion 15 covers a surface of the first portion 14. Specifically, the second portion 15 is a second PU film or a second TPU film. Furthermore, the outer layer 2 includes a third portion 22 and a fourth portion 23. The fourth portion 23 is an airtight fourth portion 23, and the fourth portion 23 covers a surface of the third portion 22. Furthermore, the fourth portion 23 is a fourth PU film or a fourth TPU film. The hollow openings 13 run through the first portion 14 and the second portion 15. A plurality of through holes 231 are defined in the fourth portion 23, and the through holes 231 are oriented towards the hollow opening 13. Specifically, the first portion 14 is a breathable first portion 14, and the third portion 22 is a breathable third portion 22. Through the above structure, the second portion 15 is the airtight second portion 15, the second portion 15 covers the surface of the first portion 14, the fourth portion 23 is the airtight fourth portion 23, and the fourth portion 23 covers the surface of the third portion 22, so that the air entering the air cavity 3 can only be blown out from the air outlets 11 to accurately blow towards body parts that need to dissipate heat, thereby improving a heat dissipation effect of the garment. Moreover, the hollow openings 13 run through the first portion 14 and the second portion 15, the plurality of through holes 231 are defined in the fourth portion 23, and the through holes 231 are oriented towards the hollow opening 13, so that only fabric of the first portion 14 of the outer layer 2 is present at the hollow openings 13, allowing for natural heat dissipation at the hollow openings 13 through a single layer of fabric of the breathable first portion 14.

In this embodiment, the inner layer 1 includes a first portion 14 and a second portion 15. The second portion 15 is an airtight second portion 15, and the second portion 15 covers a surface of the first portion 14. The outer layer 2 includes a third portion 22 and a fourth portion 23. The fourth portion 23 is an airtight fourth portion 23, and the fourth portion 23 covers the third portion 22. The first portion 14 includes a first inner surface 141 and a first outer surface 142. The second portion 15 covers the first inner surface 141. The third portion 22 includes a second inner surface 221 and a second outer surface 222. The fourth portion 23 covers the second inner surface 221. The air cavity 3 is formed between the second portion 15 and the fourth portion 23. The air cavity is formed between the second inner surface and the first outer surface. The inner layer 1 is also provided with a first connection area 12, and the outer layer 2 is also provided with a second connection area 21 disposed towards the first connection area 12. The second connection area 21 is connected to the first connection area 12 to form a partition portion 5, and the partition portion 5 divides the air cavity 3 into a plurality of intercommunicated air ducts 51. The air inlet 31, the air ducts 51, and the air outlets 11 are in communication with each other. The fan 4 is used for driving the air to pass through the air inlet 31, the air ducts 51, and the air outlets 11 in sequence. The first connection area 12 is positioned in the second portion 15, and the second connection area 21 is positioned in the fourth portion 23. Specifically, the second portion 15 and the fourth portion 23 are positioned between the first portion 14 and the third portion 22. Through the above structure, the arrangement between the inner layer 1 and the outer layer 2 is effectively achieved, and the connection between the second portion 15 and the fourth portion 23 is completed, so that the second connection area 21 is connected to the first connection area 12 to form the partition portion 5, and the partition portion 5 divides the air cavity 3 into the plurality of intercommunicated air ducts 51. In some embodiments, the second portion and the fourth portion can also be ePTFE films.

Figure 6:
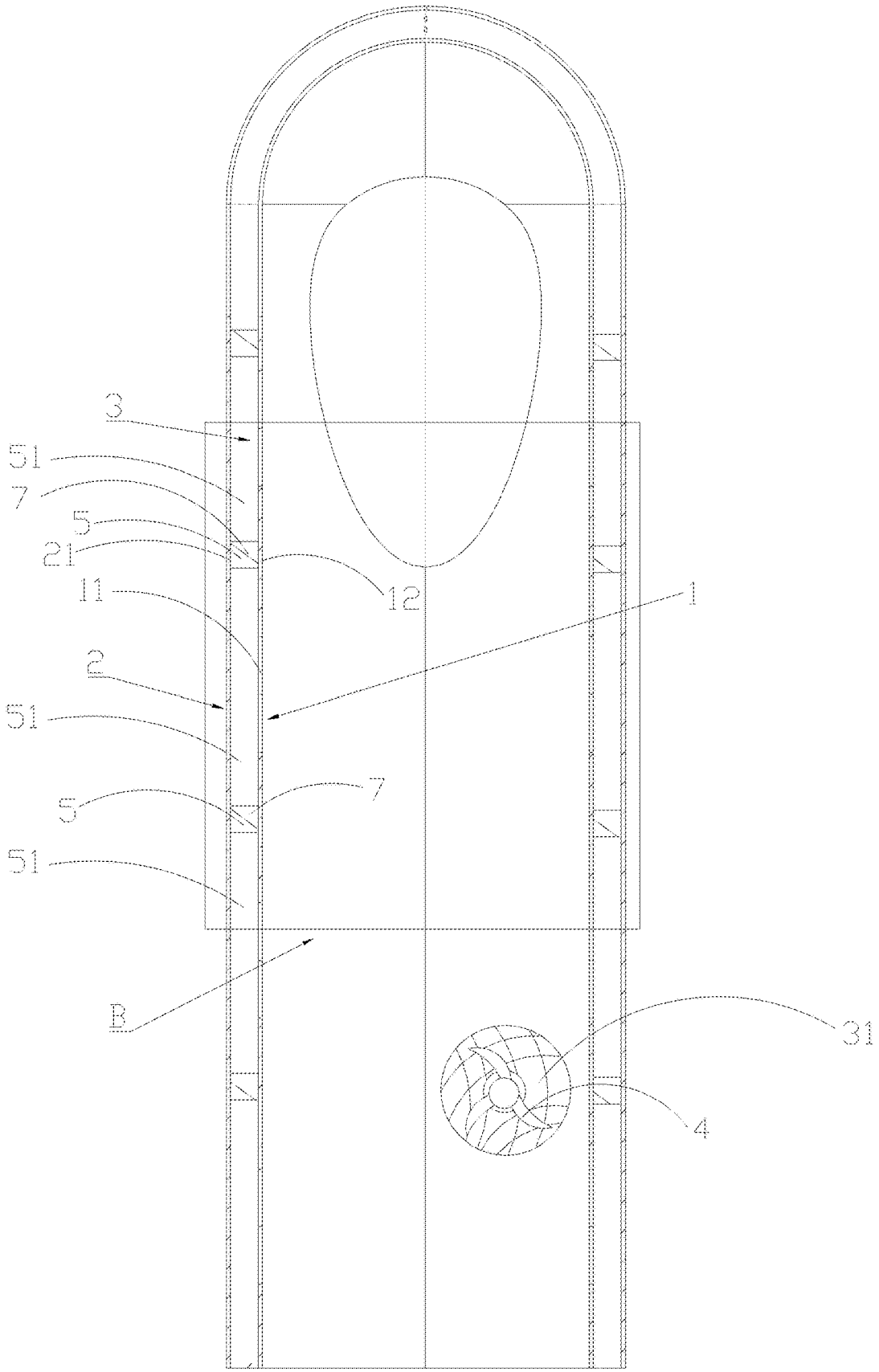
FIG. 6 is a sectional view cut along a nitrile inner layer and a nitrile outer layer.
Figure 7:
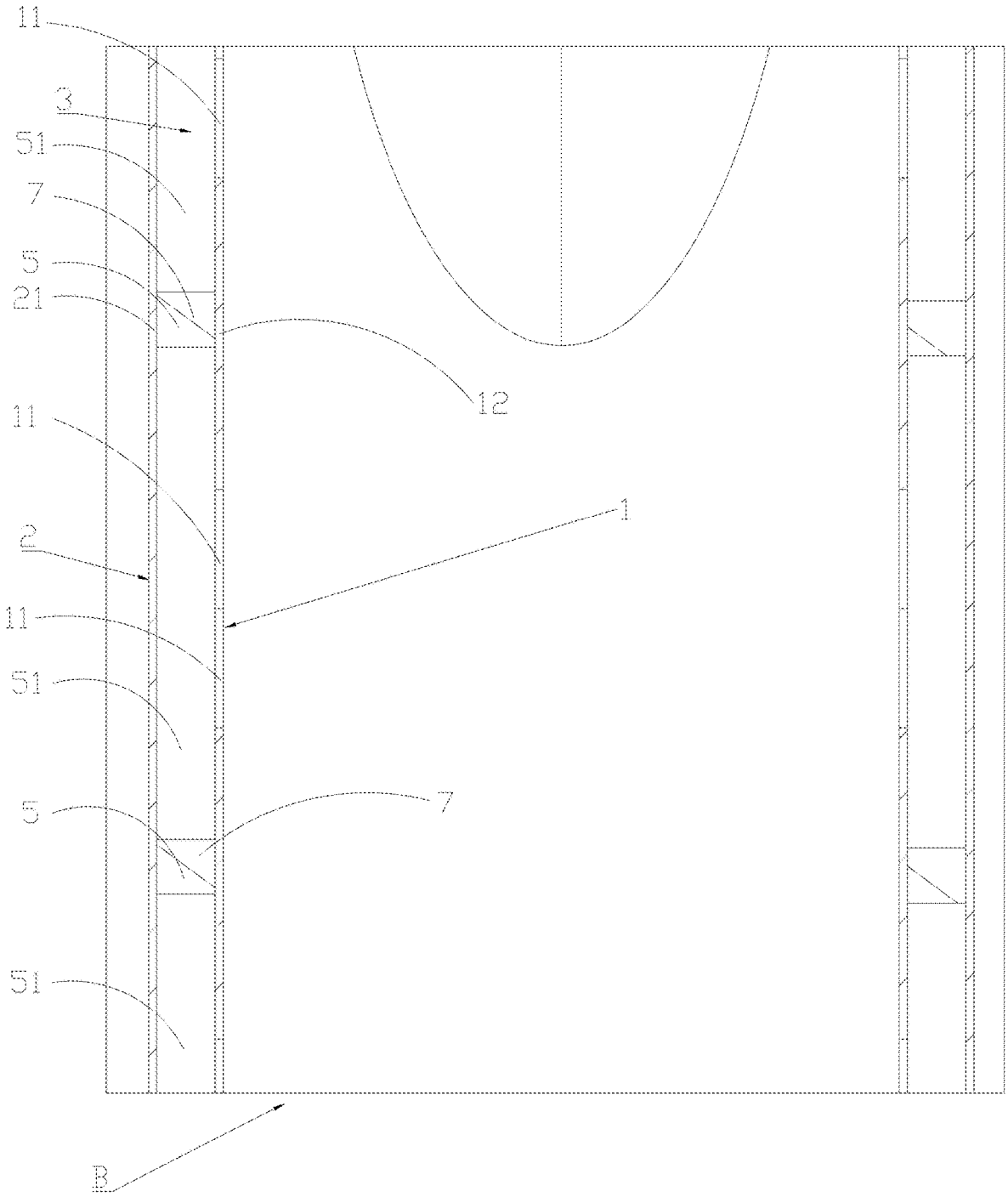
FIG. 7 is an enlarged view of area B in FIG. 6.

Referring to FIGS. 6-7, in some embodiments, the inner layer 1 is a nitrile inner layer 1. The outer layer 2 is a nitrile outer layer 2. Specifically, the inner layer 1 and the outer layer 2 are integrally formed. Furthermore, the inner layer 1 is also provided with a first connection area 12, and the outer layer 2 is also provided with a second connection area 21 disposed towards the first connection area 12. The second connection area 21 is connected to the first connection area 12 to form a partition portion 5, and the partition portion 5 divides the air cavity 3 into a plurality of intercommunicated air ducts 51. The air inlet 31, the air ducts 51, and the air outlets 11 are in communication with each other. The fan 4 is used for driving the air to pass through the air inlet 31, the air ducts 51, and the air outlets 11 in sequence. The first connection area 12 and the second connection area 21 are connected by a connecting rib 7 to form the partition portion 5. Furthermore, the connecting rib 7 is a nitrile connecting rib 7. The inner layer 1, the outer layer 2, and the connecting rib 7 are integrally formed. Through the above structure, the nitrile inner layer 1 and the nitrile outer layer 2 are easy to form, have a longer service life, and are less likely to cause skin allergies compared with latex. The connecting rib 7 is a nitrile connecting rib 7. The inner layer 1, the outer layer 2, and the connecting rib 7 are integrally formed. Moreover, the second connection area 21 is connected to the first connection area 12 to form the partition portion 5, and the partition portion 5 divides the air cavity 3 into the plurality of intercommunicated air ducts 51, so that the fan 4 can drive the air to pass through the plurality of intercommunicated air ducts 51 and then blow the air towards the user from the air outlets 11. Moreover, by dividing the air cavity 3 into the plurality of intercommunicated air ducts 51, the air flowing into the air cavity 3 is evenly distributed in the plurality of air ducts 51, making an overall shape of the garment more flat, and preventing excessive expansion of the overall shape of the garment caused by a large amount of air flowing into the air cavity 3, thus preventing the overall shape of the garment from becoming bloated and bulky. Moreover, the nitrile inner layer and the nitrile outer layer have superior strength, ductility, and tear resistance, are more durable, and have a relatively long service life. Compared with latex, the nitrile inner layer and the nitrile outer layer have stronger protective properties and lower costs, are less prone to cause allergies, and can effectively prevent chemical substances from coming into contact with the user's skin.

In this embodiment, the inner layer 1 is provided with a first main body portion 16 and a first sleeve portion 17, and the outer layer 2 is provided with a second main body portion 24 and a second sleeve portion 25. The first main body portion 16 is connected to the first sleeve portion, and the second main body portion 24 is connected to the second sleeve portion. The plurality of air outlets 11 and the plurality of hollow openings 13 are arranged at intervals along the first main body portion 16 and the second main body portion 24. Through the above structure, the plurality of air outlets 11 and the plurality of hollow openings 13 are arranged at intervals along the first main body portion 16 and the second main body portion 24, so that air can be discharged from both the sleeve portion and the main body portion, providing comprehensive heat dissipation and cooling for the user's chest, back, and arms.

In this embodiment, the inner layer 1 includes a first portion 14 and a second portion 15. The second portion 15 is an airtight second portion 15, and the second portion 15 covers a surface of the first portion 14. The second portion is adhered to the surface of the first portion 14 by hot melt adhesive. The outer layer 2 includes a third portion 22 and a fourth portion 23. The fourth portion 23 is an airtight fourth portion 23, and the fourth portion 23 covers the third portion 22. The fourth portion is adhered to a surface of the third portion 22 through hot melt adhesive. The hollow openings 13 run through the first portion 14 and the second portion 15. A plurality of through holes 231 are defined in the fourth portion 23, and the through holes 231 are oriented towards the hollow openings 13. A thickness of the second portion 15 is greater than or equal to 0.01 mm, a thickness of the fourth portion 23 is greater than or equal to 0.01 mm, a thickness of the outer layer 2 is greater than or equal to 0.05 mm, a thickness of the inner layer 1 is greater than or equal to 0.05 mm, an inner diameter of the air outlet 11 is greater than or equal to 0.01 mm, and an inner diameter of the hollow opening 13 is greater than or equal to 0.01 mm. Through the above structure, the size design is reasonable and an effect of air discharge is good, which can effectively improve a heat dissipation and cooling effect of the garment.

In this embodiment, the fan is detachably connected to the inner layer or the outer layer, so that the fan is positioned at the air inlet. Specifically, the fan is detachably connected to the inner layer or the outer layer through buckles or magnetic attraction, making it easier for the user to remove the fan when cleaning the garment, extending the service life of the whole garment and the fan.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A garment, comprising:

an inner layer, wherein the inner layer is equipped with a plurality of air outlets;

an outer layer, wherein the outer layer is connected to the inner layer, an air cavity is formed between the outer layer and the inner layer, and the air cavity is provided with an air inlet; the air inlet, the air cavity, and the air outlets are in communication with each other; and a fan, wherein the fan is positioned at the air inlet, and the fan is used for driving air to pass through the air inlet, the air cavity and the air outlets in sequence, wherein the inner layer is also provided with a first connection area, the outer layer is also provided with a second connection area disposed towards the first connection area, the second connection area is connected to the first connection area to form a partition portion, and the partition portion divides the air cavity into a plurality of intercommunicated air ducts; the air inlet, the air ducts, and the air outlets are in communication with each other; the fan is used for driving the air to pass through the air inlet, the air ducts, and the air outlets in sequence; the first connection area and the second connection area are connected by a connecting rib to form the partition portion; the connecting rib is a nitrile connecting rib; the inner layer, the outer layer, and the connecting rib are integrally formed.

2. The garment according to claim 1, wherein a plurality of hollow openings are defined in the inner layer, the first connection area comprises a plurality of first connection parts, the second connection area comprises a plurality of second connection parts, the partition portion comprises a plurality of partition units, the first connection parts are positioned at edges of the hollow openings, the plurality of first connection parts are connected to the plurality of second connection parts to form the plurality of partition units, the partition units are positioned between the hollow openings and the air ducts, the plurality of partition units separate the plurality of hollow openings from the air cavity, and the plurality of partition units divide the air cavity into the plurality of intercommunicated air ducts.

3. The garment according to claim 2, wherein the plurality of first connection parts are spaced apart from each other, the plurality of second connection parts are spaced apart from each other, the plurality of hollow openings are spaced apart from each other, and the plurality of partition units are spaced apart from each other; and the plurality of air outlets and the plurality of hollow openings are spaced apart from each other.

4. The garment according to claim 2, wherein the plurality of first connection parts are uniformly arranged along a transverse direction of the inner layer and a longitudinal direction of the inner layer, and the plurality of second connection parts are uniformly arranged along a transverse direction of the outer layer and the longitudinal direction of the inner layer; and the plurality of air outlets are uniformly arranged along the transverse direction of the inner layer and the longitudinal direction of the inner layer.

5. The garment according to claim 1, wherein the first connection area and the second connection area are connected by a hot melt adhesive body to form the partition portion.

6. The garment according to claim 1, wherein the inner layer is an airtight inner layer, and the outer layer is an airtight outer layer.

7. The garment according to claim 6, wherein the inner layer comprises a first portion and a second portion, the second portion is an airtight second portion, and the second portion covers a surface of the first portion.

8. The garment according to claim 7, wherein the second portion is a TPU film.

9. The garment according to claim 6, wherein the outer layer comprises a third portion and a fourth portion, the fourth portion is an airtight fourth portion, and the fourth portion covers a surface of the third portion.

10. The garment according to claim 9, wherein the fourth portion is TPU film.

11. The garment according to claim 1, wherein the inner layer comprises a first portion and a second portion, the second portion is an airtight second portion, and the second portion covers a surface of the first portion; the outer layer comprises a third portion and a fourth portion, the fourth portion is an airtight fourth portion, and the fourth portion covers the third portion; the first portion comprises a first inner surface and a first outer surface, the second portion covers the first inner surface, the third portion comprises a second inner surface and a second outer surface, the fourth portion covers the second inner surface, and the air cavity is formed between the second portion and the fourth portion.

12. The garment according to claim 1, wherein the inner layer is a nitrile inner layer.

13. The garment according to claim 12, wherein the outer layer is a nitrile outer layer.

14. The garment according to claim 13, wherein the inner layer and the outer layer are integrally formed.

15. The garment according to claim 2, wherein the inner layer is provided with a first main body portion and a first sleeve portion, the outer layer is provided with a second main body portion and a second sleeve portion, the first main body portion is connected to the first sleeve portion, the second main body portion is connected to the second sleeve portion, the plurality of air outlets and the plurality of hollow openings are arranged at intervals along the first main body portion and the second main body portion.

16. The garment according to claim 2, wherein the inner layer comprises a first portion and a second portion, the second portion is an airtight second portion, the second portion covers a surface of the first portion; the outer layer comprises a third portion and a fourth portion, the fourth portion is an airtight fourth portion, the fourth portion covers the third portion, and the fourth portion is adhered to a surface of the third portion through hot melt adhesive; the hollow openings run through the first portion and the second portion; a plurality of through holes are defined in the fourth portion, and the through holes are oriented towards the hollow openings; a thickness of the second portion is greater than or equal to 0.01 mm, a thickness of the fourth portion is greater than or equal to 0.01 mm, a thickness of the outer layer is greater than or equal to 0.05 mm, a thickness of the inner layer is greater than or equal to 0.05 mm, an inner diameter of the air outlet is greater than or equal to 0.01 mm, and an inner diameter of the hollow opening is greater than or equal to 0.01 mm.

17. The garment according to claim 1, wherein the fan is detachably connected to the outer layer, so that the fan is positioned at the air inlet.

* * * * *